US005544025A

United States Patent [19]

Bohlool et al.

[11] Patent Number: 5,544,025

[45] Date of Patent: Aug. 6, 1996

[54] OUTLET COVER PLATE INCORPORATING A NIGHTLIGHT

[75] Inventors: Perry P. Bohlool, Lake Ridge, Va.; George J. Ricci, Danville, Ky.

[73] Assignee: Standard Enterprises, Inc., Woodbridge, Va.

[21] Appl. No.: 253,024

[22] Filed: Jun. 2, 1994

[51] Int. Cl.[6] ..... F21V 33/00

[52] U.S. Cl. ..... 362/95; 362/249; 362/309; 439/490

[58] Field of Search ..... 362/95, 226, 249, 362/309, 339; 439/490, 536

[56] References Cited

U.S. PATENT DOCUMENTS

| | | | |
|---|---|---|---|
| D. 330,267 | 10/1992 | Hendrix . | |
| 2,015,698 | 10/1935 | Tiffany . | |
| 2,420,000 | 5/1947 | Linton . | |
| 2,449,150 | 9/1948 | Schnoll | 362/95 |
| 3,203,126 | 8/1965 | Eliot | 362/226 |
| 3,307,030 | 2/1967 | De Francisco | 362/95 |
| 3,588,489 | 6/1971 | Gaines . | |
| 3,706,004 | 12/1972 | Schwartz | 362/226 |
| 3,739,226 | 6/1973 | Seiter et al. | 362/20 |
| 4,000,405 | 12/1976 | Horwinski | 362/95 |
| 4,255,780 | 3/1981 | Sakellaris . | |
| 4,611,266 | 9/1986 | Schwartz | 362/226 |
| 4,617,613 | 10/1986 | Rice . | |
| 4,774,641 | 9/1988 | Rice . | |
| 4,931,911 | 6/1990 | Hanson . | |
| 5,339,231 | 8/1994 | Parsolano et al. | 362/95 |

FOREIGN PATENT DOCUMENTS

| | | | |
|---|---|---|---|
| 2097110 | 10/1982 | United Kingdom | 362/226 |

*Primary Examiner*—Denise L. Gromada
*Assistant Examiner*—Sara Sachie Raab
*Attorney, Agent, or Firm*—Wigman, Cohen, Leitner & Myers, P.C.

[57] ABSTRACT

A nightlight is disclosed which includes, in a single unitary fixture, an outlet cover plate having a rearward extending set of male contacts which cover and plug directly into a first set of the duplex outlet receptacle contacts and a nightlight portion having extended life characteristics and extending forward of the cover plate. The unit simply and easily plugs into a standard duplex outlet. The plug may extend into a first one of the receptacles and the forward extending portion covers a second one of the receptacles. The cover plate and nightlight combination is simply secured with at least one ordinary screw fastener in such a manner as can be accomplished with a minimum level of skill, well within that of the ordinary homeowner.

21 Claims, 1 Drawing Sheet

OUTLET COVER PLATE INCORPORATING A NIGHTLIGHT

FIELD OF THE INVENTION

The present invention relates to electrical outlet cover plates and nightlights, and more particularly to an assembly combining a duplex receptacle cover incorporating therewith an integrally molded, forward-projecting housing having an extended-life nightlight therein.

BACKGROUND OF THE INVENTION

Nightlight units which can be plugged into duplex outlets are well-known. They suffer from two conflicting problems. When nightlights known in the prior art are designed for easy replacement, they are easily removable, which is likely to be found undesirable where the public congregates or waits. A nightlight which has been removed exposes the duplex receptacle contacts to prying small fingers and deprives the area of the desired nighttime lighting, creating a safety hazard. However, when nightlights known in the prior art are designed to be secured in place to discourage theft, they are difficult to remove for maintenance when they burn out, and thus are often not replaced sufficiently promptly as the replacement procedure necessitates employment of an electrician. Conventional use of normal life bulbs exacerbates the maintenance problem.

U.S. Design Pat. No. 5,330,267 to Hendrix (issued Oct. 13, 1992) illustrates an ornamental design for a combined night light and electrical outlet cover. This design patent does not disclose how it is mechanically and electrically connected. It also extends a great distance behind the cover plate, and thus requires a dedicated wiring box. It does not show blade plugs which can simply be inserted into an existing receptacle. Bulb replacement procedures are not apparent. There is no room in the ordinary wiring box for a receptacle into which plugs can be inserted.

The patent to Tiffany (U.S. Des. Pat. No. 2,015,698 (Oct. 1, 1935) illustrates a switch cover plate incorporating a lamp which extends forward of the switch plate, in which the lamp is hard-wired (via pigtail lead eyelets) in parallel (shunt) of the switch contacts to indicate an "OFF" condition. That is, the lamp is only illuminated when the switch is open and the switched device conducts significant current. A circuit safety hazard could be presented by this device as current is allowed to flow continuously; e.g., via the switch contacts when the switch is closed, and via the bulb when the switch contacts are open.

The patent to Linton (U.S. Pat. No. 2,420,000 (May 6, 1947) illustrates a cover plate for a switch which incorporates a lamp in a special switch cover plate. Linton is directly hard-wired via pigtail leads to the connection terminals of the switch. It is not directed to a nightlight which plugs into a receptacle.

The United States patent to Gaines (U.S. Pat. No. 3,588, 489, issued Jun. 28, 1971) illustrates an electroluminescent panel exposed through a special aperture in the triple receptacle. The triple receptacle shown is unusual, and requires a special triple cover plate with an aperture substituted for the middle receptacle socket. The electroluminescent lamp panel receives electrical current through contacts which plug into the special middle socket.

The invention disclosed in Sakellaris' U.S. Pat. No. 4,255,780, issued Mar. 10, 1981, is directed to a jewelled illumination means substituted for a mounting screw. Light conveyed along an optical fiber is conveyed through the special jewelled illumination mounting screw. It would be expected to produce a very limited amount of light and is primarily directed to identify the location of an associated light switch in a darkened room.

Two United States patents have been issued to K. Q. Rice; the earlier Rice patent (U.S. Pat. No. 4,617,613, dated Oct. 14, 1986) is directed to a duplex receptacle cover with an integral light. The form and arrangement of the dual-function contacts permits use of the second outlet of the duplex receptacle, unlike the embodiments of the present invention to disclosed herein. A first contact blade is V-shaped so as to present a female contact to the front and a male contact on the back which plugs into the "hot" side of the receptacle. The remaining contact (i.e., spring element 18) contacts ground to complete the circuit. The ground lead of the bulb does not complete its circuit to the neutral phase, which may not be permitted by some electrical codes.

The later Rice patent (U.S. Pat. No. 4,774,641, dated Sep. 27, 1988) discloses a duplex cover with an add-on light (bolted from the rear of the cover plate). It, too, avoids covering the duplex receptacles, through use of two of the V-shaped dual-function blade contacts which accept plug blades thereinto. The cover plate and outlet body cooperate to assure blade socket and ground socket alignment.

U.S. Pat. No. 4,931,911 to Hanson discloses a permanently affixed conventional nightlight design which further includes a bracket in the special cover plate front face a U-shaped flange 16 for frictionally holding the lamp portion upright. The illuminating end and the connecting end are specified as being disposed at a 90-degree angle to one another. Includes a small lip extending over the cover plate mounting screw hole for permanently securing the nightlight. It uses a hex screw for securing the cover plate.

None of the foregoing discloses a nightlight which includes, in a single unitary fixture, the combination of an outlet cover plate having a rearward extending set of male contacts which cover and plug directly into a first set of the duplex outlet receptacle contacts and a nightlight portion having extended life characteristics and extending forward of the cover plate. Nor do any of the foregoing disclose a duplex receptacle cover which provides a relatively permanently affixed, long life nightlight covering a first one of the receptacles and a plate portion covering the remaining receptacle.

In view of the foregoing limitations and shortcomings of the prior art devices, as well as other disadvantages not specifically mentioned above, it should be apparent that there still exists a need in the art for a safe, long-life nightlight. It is, therefore, a primary object of this invention to fulfill that need by providing a combination duplex outlet cover plate and nightlight having a long-life illuminant and incorporating safety and security advantages.

A feature of the invention reside in the fact that the unit simply and easily plugs into a standard duplex outlet. Another feature of the nightlight disclosed herein is that long-life illumination elements are used to avoid short bulb life and limit frequent maintenance operations to replace burned out bulbs. Yet another feature of the present invention is the inclusion of a cover over the remaining receptacle to avoid injury to children.

These and other objects, features, and advantages are accomplished with the combination nightlight and cover plate disclosed herein.

SUMMARY OF THE INVENTION

Briefly described, the aforementioned objects are accomplished according to the invention by providing the combination of a duplex outlet cover plate having a rearward extending set of male contacts which cover and plug directly into a first set of the duplex outlet receptacle contacts and a nightlight portion having extended life characteristics and extending forward of the cover plate, in a single unitary fixture. In an alternative embodiment of the invention, a duplex receptacle cover includes a permanently affixed nightlight covering a first one of the receptacles and a plate portion covering the remaining receptacle for safety. The cover plate is secured to the outlet with one or more screw fasteners, which may include screws having security or other unusual heads to prevent casual tampering.

The cover plate and nightlight combination is simply secured with at least one screw fastener in such a manner as can be accomplished with a minimum level of skill, well within that of the ordinary homeowner. The forward extending portion of the nightlight is shaped so that the extended life light source is directed into the room at an angle determined primarily by the placement of the bulb relative to a face surface of the forward extending portion. The angle can be changed by positioning the bulb axially relevant the forward extending portion face, which is preferably covered, or by use of geometric or other pattern on the face. Additionally, use of a plurality of bulbs enables selecting a light pattern by predetermined positioning of the bulbs within the forward extending portion.

Long bulb life is obtained either by selection of filament (or other light emitting element) properties, or more preferably, by a series of longer life, lower voltage bulbs wired electrically in series or series/parallel for redundancy. Since the unit is intended for essentially permanent mounting, long life light elements are preferred. Another feature of the invention derives from the use of a plurality of bulbs, in which the life of the lamp is extended at the same time that use of a plurality of bulbs enables positioning them to enhance desired light distribution.

The face is sealed and functions both to prevent intrusion by prying fingers such as those of an inquisitive child, and also to distribute the light in a preferred pattern when desired. Enhanced child safety may be provided by including a panel completely covering the second receptacle, formed integrally with the cover plate. Alternatively, the male contacts may form a plug which extends into a first one of the receptacles and the forward extending portion housing the light covers a second one of the receptacles.

With the foregoing and other objects, advantages, and features of the invention which will become hereinafter apparent, the nature of the invention may be more clearly understood by reference to the following detailed description of the invention, the appended claims, and to the several views illustrated in the attached drawings.

BRIEF DESCRIPTION OF THE DRAWING FIGURES

DETAILED DESCRIPTION OF THE PREFERRED EMBODIMENTS

Figure 1:
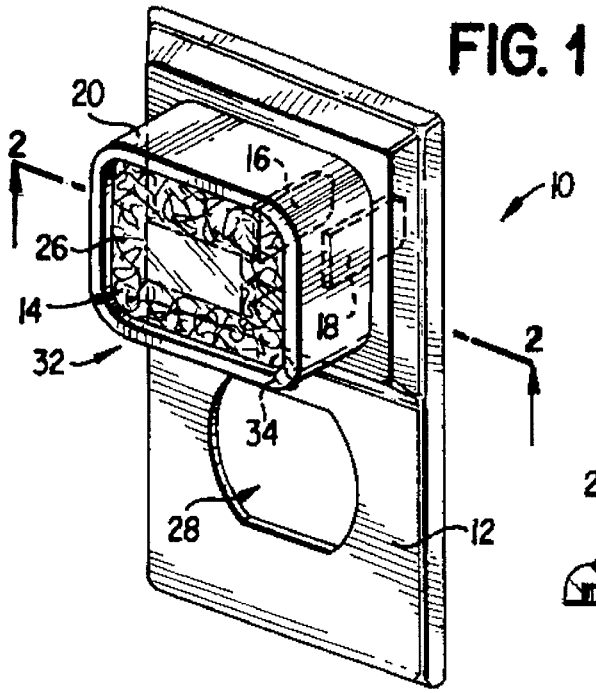
FIG. 1 is a face view of a combination duplex receptacle cover plate and nightlight according to a first embodiment of the present invention.
Figure 2:
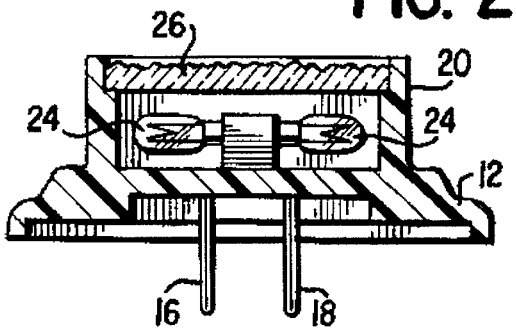
FIG. 2 is an end view of the embodiment of FIG. 1 with a portion removed to show bulbs inside the forward extending portion.

There is shown as a preferred first embodiment of the invention in FIGS. 1 and 2 a unitary duplex receptacle combination cover/nightlight 10, including a generally planar cover 12 and a light source area 14. Cover 12 is sized and shaped to cover a conventional duplex receptacle of the type in common use, whether grounded or polarized or neither. The cover 12 is made, for example, of a formed resin material having an effective, high electrical insulation value, and of suitable strength to withstand normal wear. While other materials can be used, a strong insulator material is preferred. Where needed for strength or conductivity reasons or the like, a steel or other suitable metal cover plate can be used.

A pair of electrical contacts 16, 18 extends to the rear of the cover 12, for making electrical contact with the receptacle female contacts (not shown). The receptacle and female contacts thereof do not form a part of the present invention. Conventional flat blade contacts are normally used; however, round or other configuration male terminals may also be used where appropriate. The contacts 16, 18 are positioned to be received in the receptacle female contacts and complete respective electrical circuits thereto.

Figure 4:
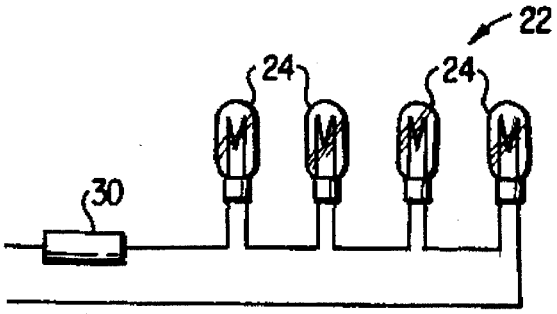
FIG. 4 is a pictorial view of a string of bulbs and a power limiting element forming a source of illumination according to the present invention.

An extension portion 20 projects forward of the cover plate 12, housing the light source. Here, a series string 22 of lower voltage bulbs 24 is shown in FIG. 4 as forming the light source. The extension portion 20 is covered with a faceplate 26 which efficiently passes light. The faceplate 26 may present a planar face or a multi-faceted geometric surface topography as shown, in order to focus, diffuse, or distribute the light as desired. The faceplate may also be decorated, colored, and/or carry a symbolic or other imprint as may be desired.

In the embodiment shown in FIGS. 1 and 2, an aperture 28 is formed in the cover 12 in front of the second of the duplex receptacle contact areas, as for accepting an ordinary electrical plug. Alternatively, this aperture 28 can be eliminated and covered so as to block intrusion of foreign elements, such as straight pins, safety pins, hairpins, nails, etc. which could present hazards to children or the retarded. No preference is expressed for whether the male contacts extend rearward from the cover plate area to the first or second receptacle contacts, or from behind the extension portion 20 or otherwise. Normally, the male contacts 16, 18 extend rearward of the extension portion.

Within the extension portion 20 and behind the faceplate 26 lies a source of illumination, comprising one or more electrical lamps, bulbs 24, or the like, which preferably exhibit long-life characteristics. In FIG. 4 a series-connected string 22 of lower-voltage long-life bulbs 24 is shown, and may further include a voltage or current limiting element 30 to protect the lamp(s) from electrical surges which could otherwise shorten the life of the light source. The lamp(s) may be positioned within extension portion 20 as desired to provide a particular light distribution or intensity pattern. In this regard, it may also be desirable to form at least a portion 32 of the cover plate 12 of translucent material to provide a desired light pattern in a desired direction from the receptacle location. For example, lower portion 32 of the cover plate 12 may be translucent in order to project some light downward to illuminate either a plug passing through aperture 28 into a receptacle or to illuminate the floor, or all of the foregoing.

A conventional single fastener mounting hole 34 is provided for securing the combination cover/nightlight 10 to the receptacle. One or more fasteners may be used to secure the combination 10 to the wiring box (not shown). Threaded fasteners having various heads adapted for different tools can be selected for security reasons to prevent unauthorized removal of the cover/nightlight 10.

Figure 3:
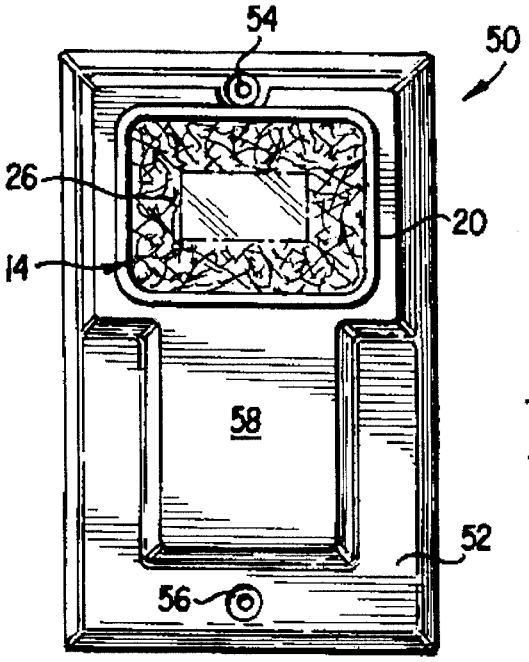
FIG. 3 is a face view of an alternate embodiment of the present invention.

Turning now to FIG. 3, there is shown therein an alternate cover/nightlight 50, in which the first receptacle (not shown) is superposed by the nightlight portion such that access to the second receptacle is blocked by a portion 58 of the cover 52. A pair of apertures 54, 56 are provided with which fasteners (not shown) secure the cover/nightlight 52 to the receptacle. In other respects, this second embodiment is substantially identical to combination cover/nightlight 10, described above.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

We claim:

1. A combination cover and nightlight for use with a duplex receptacle, comprising:

a generally planar duplex receptacle cover having a plane surface to be disposed immediately in front of said duplex receptacle;

a light source;

means for housing the light source, comprising a light source area integrally formed with the cover by an extension portion of the cover and which extension portion projects forward of the cover plane to form the housing means;

a pair of male only electrical contacts which extend to the rear of the cover to engage and connect to female contacts in one-half of the duplex receptacle, and being further connected to said light source; and a faceplate adapted for light transmission therethrough, covering the housing means and being non-removably joined thereto;

wherein the cover blocks external access to at least one-half of the duplex receptacle.

2. The combination cover and nightlight of claim 1, wherein the light source comprises at least one electric lamp.

3. The combination cover and nightlight of claim 1, wherein the lamp is adapted to provide a substantially longer than normal useful operating life.

4. The combination cover and nightlight of claim 1, wherein the light source comprises a series connected string of electric lamps.

5. The combination cover and nightlight of claim 1, further including an electrical contact for connection from the cover to ground through a female contact on the duplex receptacle.

6. The combination cover and nightlight of claim 1, wherein the faceplate has a multi-faceted geometric surface topography.

7. The combination cover and nightlight of claim 1, further including an aperture formed in the cover to permit unrestricted access to one receptacle of the duplex receptacle.

8. The combination cover and nightlight of claim 1, further including means for protecting the light source from electrical surges.

9. The combination cover and nightlight of claim 1, further including means for directing the light source in a desired light pattern in a desired direction from the light source, wherein the housing means includes a light transmission path on one side of said housing means.

10. The combination cover and nightlight of claim 1, further including:

an aperture through said planar cover adapted to serve as a fastener mounting hole.

11. A combination cover and nightlight for use with a duplex receptacle having first and second sockets, comprising:

a generally planar duplex receptacle cover having a plane surface to be disposed immediately in front of said duplex receptacle;

a light source;

means for housing the light source, comprising a light source area integrally formed with the cover by an extension portion of the cover and which extension portion projects forward of the cover plane to form the housing means;

a pair of male only electrical contacts which extend to the rear of the cover to engage and connect to female contacts in one-half of the duplex receptacle, and being further connected to said light source; and a faceplate covering the housing means and being adapted for light transmission therethrough;

further including means formed in the cover for blocking access to both sockets of the duplex receptacle.

12. The combination cover and nightlight of claim 11, wherein the light source comprises at least one electric lamp.

13. The combination cover and nightlight of claim 11, wherein the lamp is adapted to provide a substantially longer than normal useful operating life.

14. The combination cover and nightlight of claim 11, wherein the light source comprises a series connected string of electric lamps.

15. The combination cover and nightlight of claim 11, further including an electrical contact for connection from the cover to ground through a female contact on the duplex receptacle.

16. The combination cover and nightlight of claim 11, wherein the faceplate has a multi-faceted geometric surface topography.

17. The combination cover and nightlight of claim 11, wherein the light source housing projects forward of the cover plane in front of one of the sockets of the duplex receptacle, and the male only contacts extend rearward of the cover plane behind the light source housing.

18. The combination cover and nightlight of claim 11, further including means for protecting the light source from electrical surges.

19. The combination cover and nightlight of claim 11, further including means for directing the light source in a desired light pattern in a desired direction from the light source, wherein the housing means includes a light transmission path on one side of said housing means.

20. The combination cover and night light of claim 11, further including:

at least one aperture through the planar cover adapted to serve as a fastener mounting hole.

21. A combination cover and nightlight for use with a duplex receptacle having two female sockets, comprising:

a generally planar duplex receptacle cover having a generally planar rear plane surface to be disposed immediately in front of said duplex receptacle and a generally planar front surface portion;

a light source;

means for housing the light source, comprising a light source area integrally formed by an extension portion of the cover and which extension portion projects forward of the cover plane to form the housing means;

a pair of male electrical contacts which extend to the rear of the cover to engage and connect to female contacts in one-half of the duplex receptacle, and being further connected to said light source; and a faceplate covering the housing means and being adapted for light transmission therethrough;

wherein the cover blocks external access to at least one-half of the duplex receptacle and is of such a thickness dimension so as permit an exposed duplex receptacle socket to fit substantially flush with the cover front surface.

* * * * *